US005173982A

United States Patent [19]

Lovett et al.

[11] Patent Number: 5,173,982

[45] Date of Patent: Dec. 29, 1992

[54] CORROSION PROTECTION SYSTEM

[75] Inventors: Thomas G. Lovett, Clearwater; Steven L. Stroh, Tampa, both of Fla.

[73] Assignee: Greiner Inc, Southern, Tampa, Fla.

[21] Appl. No.: 736,049

[22] Filed: Jul. 25, 1991

[51] Int. Cl.[5] ..... E01D 11/00; E01D 17/00; D02G 3/36

[52] U.S. Cl. ..... 14/22; 57/214; 57/217

[58] Field of Search ..... 14/22; 242/54 R; 57/215-219, 210-214, 220-223; 29/419.1, 447, 728

[56] References Cited

U.S. PATENT DOCUMENTS

| | | | |
|---|---|---|---|
| 3,800,522 | 4/1974 | Hughes et al. | 57/215 |
| 3,919,762 | 11/1975 | Borelly | 29/447 |
| 4,117,582 | 10/1978 | Borelly | 29/423 X |
| 4,569,708 | 2/1986 | Tankara et al. | 14/22 |
| 4,633,540 | 1/1987 | Jungwirth et al. | 14/21 X |
| 4,718,965 | 1/1988 | Finsterwalder et al. | 52/230 X |
| 4,799,307 | 1/1989 | Reigstad | 14/22 X |

*Primary Examiner*—Ramon S. Britts
*Assistant Examiner*—Nancy P. Connolly
*Attorney, Agent, or Firm*—A. W. Fisher, III

[57] ABSTRACT

A corrosion protection system for bridge stay cables comprising the immersion of the bridge stay cables in a corrosive resistant liquid retained within a corresponding cable sheath to isolate the bridge stay cables from the surrounding atmosphere, a liquid flow control device corresponding to each cable sheath to selectively drain condensation or purge the corrosive resistant liquid from the respective cable sheaths and a liquid supply reservoir corresponding to each cable sheath to selectively feed the corrosive resistant liquid to and from the corresponding cable sheath in response to changes in the temperature in the surrounding atmosphere, the system having the unique capability of providing a verifiable corrosion protection system for the stay cables.

20 Claims, 5 Drawing Sheets

CORROSION PROTECTION SYSTEM

BACKGROUND OF THE INVENTION

1. Field of the Invention

A corrosion protection system for bridge stay cables.

2. Description of the Prior Art

The development of cable-stayed bridges has broadened the design and construction of bridges over bridge systems such as truss girders, arches and suspension bridges. Corrosion protection of the stay cables for cable-stayed bridges is essential to the durability and longevity of such bridges.

Typically the cables are protected by coating the strands or wires with a synthetic resin cover disposed within a tube and injection of a rust resistant solidifying filler such as cement into the tube surrounding the strands or wires.

U.S. Pat. No. 4,633,540 teaches a corrosion protection system for a stayed girder bridge including protection of the ends of the tensioning elements located in the anchorages by filling the space containing the protruding ends of the tension elements with the synthetic resin. As set forth in Column 2, lines 53 and 54, the invention is directed to " . . . , a temporary corrosion protection must be provided at the construction site." As shown in FIG. 2*b* of U.S. Pat. No. 4,633,540, the diagonal cable can be replaced when the space within the tubular sheathing 5 and the anchor tube 9' is filled with a non-hardenable corrosion protection material 6' such as grease.

U.S. Pat. No. 4,799,307 discloses an anchor apparatus which provides corrosion protection for the exposed cable in a region where the anchor body is attached to a tendon of a prestressed concrete slab. Fittings are provided for inserting corrosion resistant grease into interior cavities as a second line of corrosion protection.

U.S. Pat. No. 4,569,708 shows a method of fitting a corrosion protective sheath on a cable including the steps of fitting a sheath unit on one end of a cable, shifting the position of the fitted sheath unit toward the outer end of the cable, fitting a second sheath unit similarly on the cable in continuation from the preceding sheath unit and repeating the fitting of another sheath unit and the shift of the preceding sheath until the cable is covered with the sheath units substantially over the entire length thereof.

Unfortunately the solidifying fillers found in such systems expand and contract due to changes in temperature and are exposed to cyclic stress variations due to live loads, eventually causing the solidifying fillers to crack or flow and thereby reducing the effectiveness of the corrosion protection system.

SUMMARY OF THE INVENTION

The present invention relates to corrosion protection system for the bridge stay cables of a cable-stayed bridge.

The bridge stay cables, disposed on opposite sides of the cable-stayed bridge, are anchored or secured to the cable-stayed bridge by corresponding upper and lower anchors.

Each bridge stay cable together with the corresponding upper anchor and lower anchor cooperatively forms a bridge stay cable means. Each bridge stay cable comprises a bundle of cable strands or wires each disposed in space relationship relative to a corresponding outer cable sheath forming a cable liquid chamber to receive a corrosive resistant liquid as described more fully hereinafter.

The upper and lower anchor each comprises a hollow outer guide having an anchor head disposed in the outer end thereof to anchor individual cable strands or wires thereto. A plurality of liquid flow apertures is formed through the anchor head disposed adjacent an anchor head liquid reservoir. A liquid feed conduit is coupled to the anchor head liquid reservoir through a liquid port.

The hollow outer guide forms an anchor liquid chamber extending between the cable liquid chamber and the anchor head liquid reservoir.

The corrosive protection system further includes a liquid supply means comprising a liquid supply reservoir and liquid supply manifold mounted to the cable-stayed bridge. The liquid supply reservoir comprises a liquid container open to the atmosphere through a liquid reservoir vent and having a liquid level indicia comprising a plurality of liquid level markings formed thereon. The liquid supply manifold comprises a primary manifold conduit coupled between a liquid reservoir outlet and each of the plurality of liquid feed conduits to feed the corrosive resistant liquid between the liquid container and the individual bridge cable stay means comprising the individual bridge stay cables and corresponding upper and lower anchors.

When in use, the corrosion protection system immerses the entire length of each cable strand or wires disposed within the corresponding cable liquid chamber and the corresponding anchor liquid chambers of the upper and lower anchors in a corrosion resistant liquid such as oil. Once the cable-stayed bridge is constructed and the bridge stay cable means are in place, the corrosion resistant liquid is added to the corrosion protection system through the liquid supply reservoir or through the lower anchor liquid port. More particularly, the corrosion resistant liquid is fed from the liquid container through the primary liquid conduit of the liquid supply manifold to the individual bridge stay cable means including corresponding anchor head liquid reservoirs and anchor liquid chambers of the upper anchors, cable liquid chambers and, anchor liquid chambers and anchor head liquid reservoirs of the lower anchors. Sufficient corrosive resistant liquid is added to the corrosive protection system to at least partially fill the liquid container. The discrete liquid level markings correspond to a predetermined volume of corrosive resistant liquid that correspond to predetermined temperatures to provide a visual indication of the total volume of the corrosive resistant liquid within the entire corrosion protection system. Of course, a float or other sensing means may be used to provide an electro-mechanical indication of the liquid level of the corrosion resistant liquid. Alternately, the corrosive resistant liquid may be introduced into the corrosion protection system through the lower anchor structure. Any individual bridge stay cable means may be isolated from the liquid supply means by closing the corresponding liquid flow control of the upper anchors. In addition, any individual bridge stay cable means may be drained by opening the corresponding liquid flow control valve of the lower anchor.

Thus the corrosion protection system provides a positive and verifiable corrosion protection, isolation of the cable strands from the corresponding cable sheaths and allows the rejacking of the cable strands after construction of the cable-stayed bridge.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
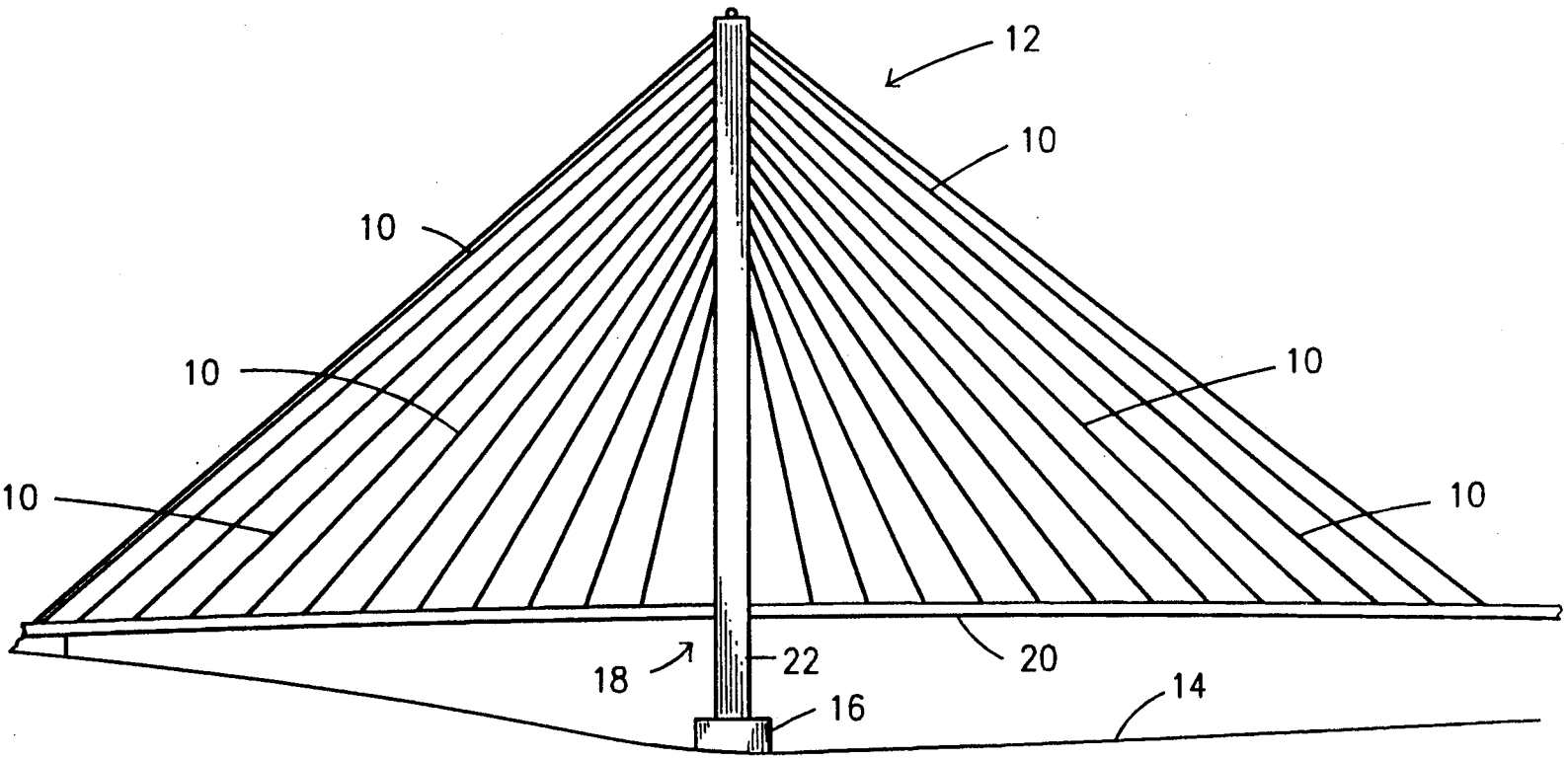
FIG. 1 is an elevation view of a cable-stayed bridge.
Figure 2:
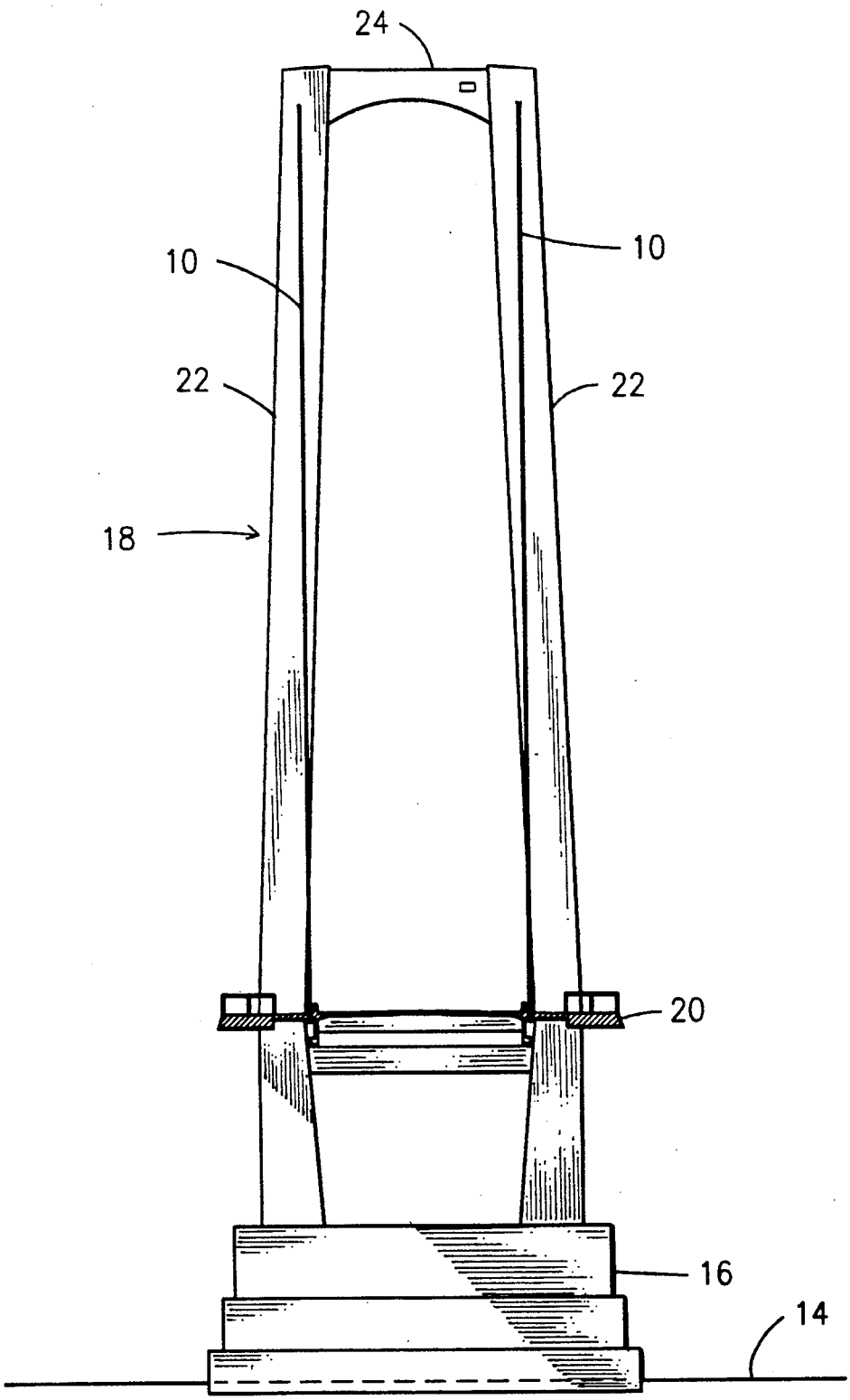
FIG. 2 is a front view of a bridge tower.

As shown in FIGS. 1 and 2, the present invention relates to corrosion protection system for the bridge stay cables each indicated as 10 of a cable-stayed bridge generally indicated as 12. As best shown in FIGS. 1 and 2, the cable-stayed bridge 12, supported on the ground 14 by a foundation or footing 16, comprises at least one tower generally indicated as 18 and a deck or superstructure indicated as 20. The tower 18 comprises one or more of substantially vertical tower members each indicated as 22 extending upwardly from the deck 20. The upper portion of the substantially vertical tower members 22 may be interconnected by a substantially horizontal tower cross-member or strut 24.

Figure 3:
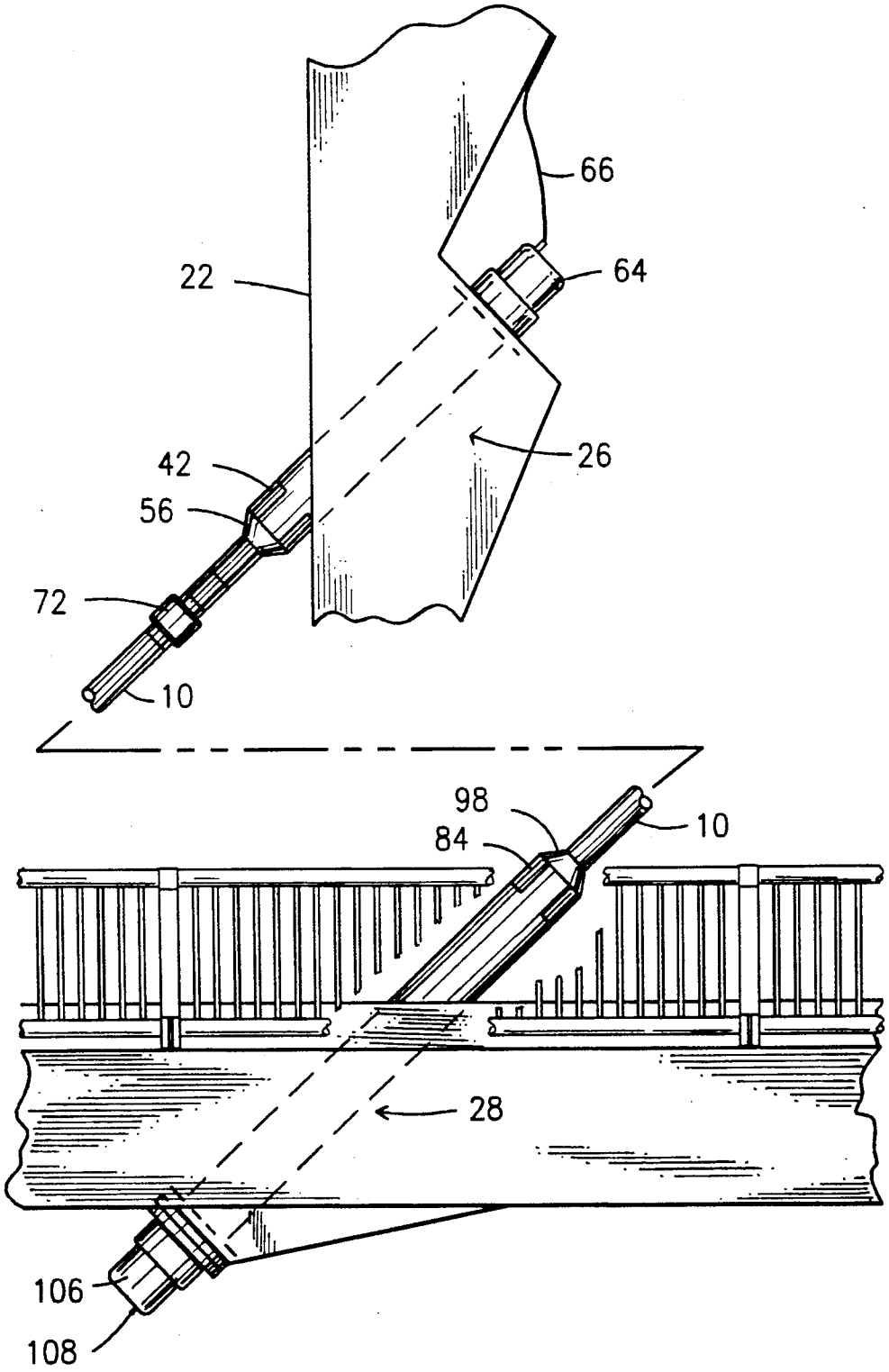
FIG. 3 is a side view of a bridge stay cable and the corrosive protection system of the present invention.

As shown in FIGS. 1 through 3, the bridge stay cables 10, which may be disposed on opposite sides of the cable-stayed bridge 12, extend between the upper portion of each substantially vertical tower member 22 and the corresponding deck 20. As shown in FIG. 3, the upper and lower portions of each bridge stay cable 10 are anchored or secured to corresponding substantially vertical tower member 22 and deck 20 by an upper and lower anchor generally indicated as 26 and 28 respectively.

Figure 4A:
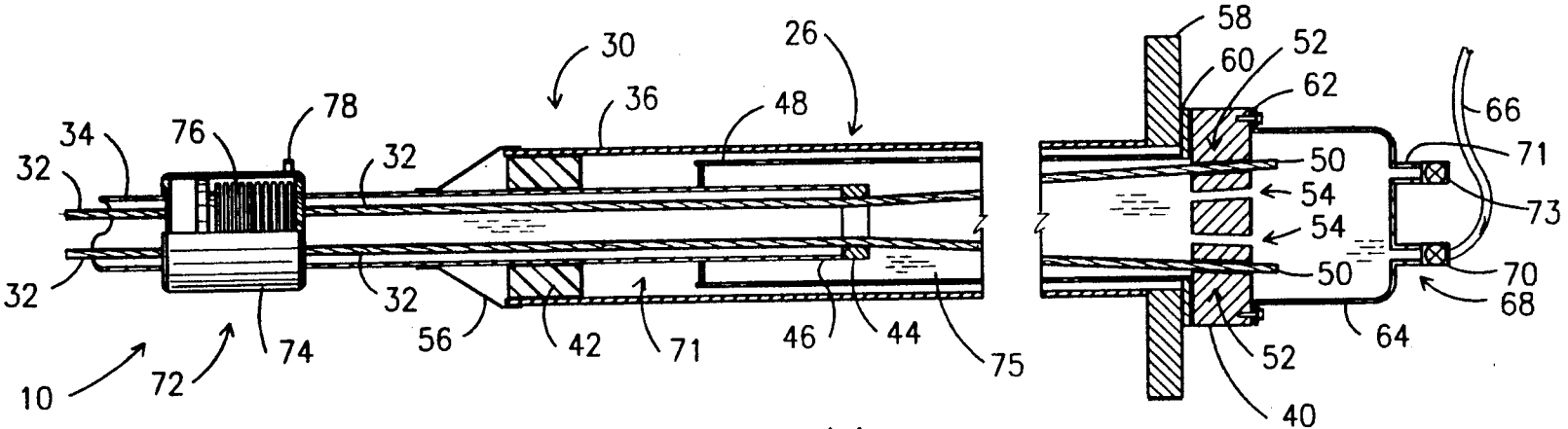
FIGS. 4A and 4B are detailed cross-sectional views of a bridge stay cable and the corrosive protection system of the present invention.
Figure 4B:
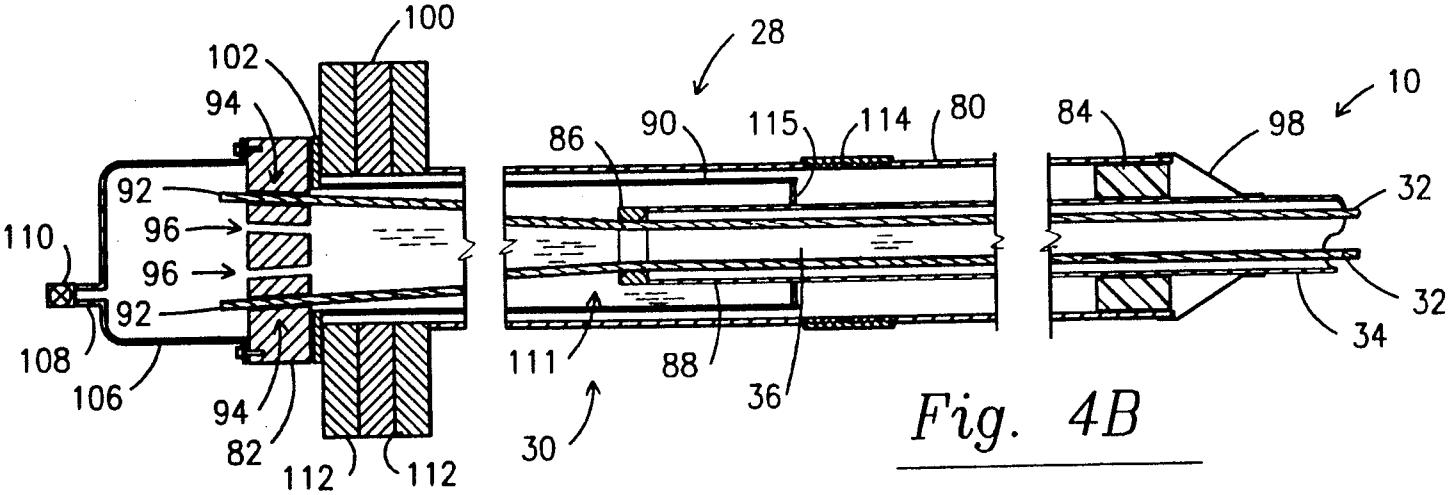
Figure 5:
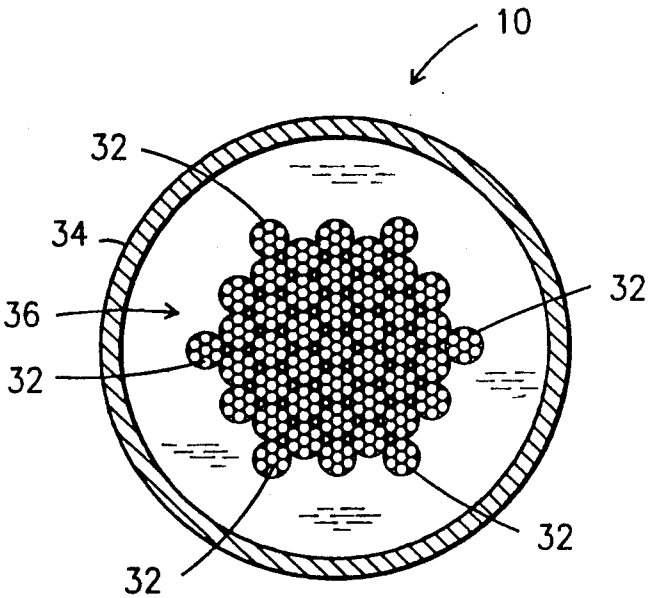
FIG. 5 is a cross-sectional end view of a bridge stay cable of the present invention.

As best shown in FIGS. 4A and 4B, each bridge stay cable 10 together with the corresponding upper anchor 26 and lower anchor 28 cooperatively form a bridge stay cable means generally indicated as 30. As best shown in FIG. 5, each bridge stay cable 10 comprises a bundle of cable strands or wires each indicated as 32 disposed in space relationship relative to a corresponding outer cable sheath 34 forming a cable liquid chamber 36 to receive a corrosive resistant liquid as described more fully hereinafter.

As best shown in FIG. 4A, the upper anchor 26 comprises a hollow outer guide pipe 38 having an anchor head 40 and a damper 42 disposed at opposite ends thereof. An annular deviator ring 44 formed on the end 46 of the cable sheath 34, which is disposed within a hollow inner deviator pipe 48 to allow separation of the individual cable strands 32 from the bundle such that the outer end 50 of each cable strand 32 may be secured to the anchor head 40 through a corresponding cable anchoring aperture 52. A plurality of liquid flow apertures each indicated as 54 is formed through the anchor head 40. The hollow inner deviator pipe 48 extends from the anchor head 40 to beyond the deviator ring 44. A boot 56 is mounted on the hollow outer guide 38 adjacent the damper 42; while, a bearing plate 58 is disposed at the opposite end of the hollow outer guide 38 adjacent the hollow inner deviator pipe 48. An inner gasket 60 is disposed in sealing relationship between the bearing plate 58 and the anchor head 40; while, an outer gasket 62 is disposed in sealing relationship between the anchor head 40 and an anchor head liquid cap 64. A liquid feed conduit 66 is coupled to the anchor head liquid cap 64 through a liquid port 68 and a liquid flow control or valve 70. The cable liquid chamber 36 may be vented through a port 71 and a control valve 73. The hollow inner deviator pipe 48 forms an anchor liquid chamber 75 extending between the cable liquid chamber 36 and the anchor head cap 64.

In addition, an expansion joint generally indicated as 72 may be coupled between the outer cable sheath 34 to isolate the strain in the cable strands 32 from the outer cable sheath 34 to eliminate fatigue stress as the cable strands 32 expand and contract due to loading on the bridge. The expansion joint 72 comprises an outer casing 74 having a bellows member 76 disposed therein. A purge/vent connection 78 formed on the outer casing 74 permits the selectively venting or purging the interior thereof.

As best shown in FIG. 4B, the lower anchor 28 is similarly constructed. Specifically, the lower anchor 28 comprises a hollow outer guide 80 having an anchor head 82 and a damper 84 disposed at opposite ends thereof. An annular deviator inner ring 86 formed on the end 88 of the cable sheaths 34, which is disposed within the hollow deviator pipe 90 to allow separation of the individual cable strands 32 from the bundle such that the outer end 92 of each cable strand 32 may be secured to the anchor head 82 through a corresponding cable anchoring aperture 94. A plurality of liquid flow apertures each indicated as 96 is formed through the anchor head 82. The hollow inner deviator pipe 90 extends between the anchor head 82 and beyond the deviator ring 86. A boot 98 is mounted on the hollow outer guide 80 adjacent the damper 84; while, a bearing plate 100 is disposed at the opposite end of the hollow outer guide 80 adjacent the hollow inner deviator pipe 90. An inner gasket 102 is disposed in sealing relationship between the bearing plate 100 and the anchor head 82; while, an outer gasket 104 is disposed in sealing relationship between the anchor head 82 and an anchor head cap 106. The anchor head cap 106 includes a liquid port 108 and a liquid flow control or valve 110. The hollow inner deviator pipe 90 forms an anchor liquid chamber 111 extending between the cable liquid chamber 36 and the anchor head cap 106. In addition, one or more shims, each indicated as 112 may be mounted adjacent the bearing plate 100 at either upper anchorage 26 or lower anchorage 28. A threaded coupler 114 is connected to the hollow outer guide 80 to permit a field welded seal to be prepared between the end closure plate 115 and the hollow deviator pipe 90. This field prepared closure is generally required to permit an initial adjustment in the outer cable sheath 34 to correspond to the initial elongation of the individual cable strands 32 upon installation.

Figure 6:
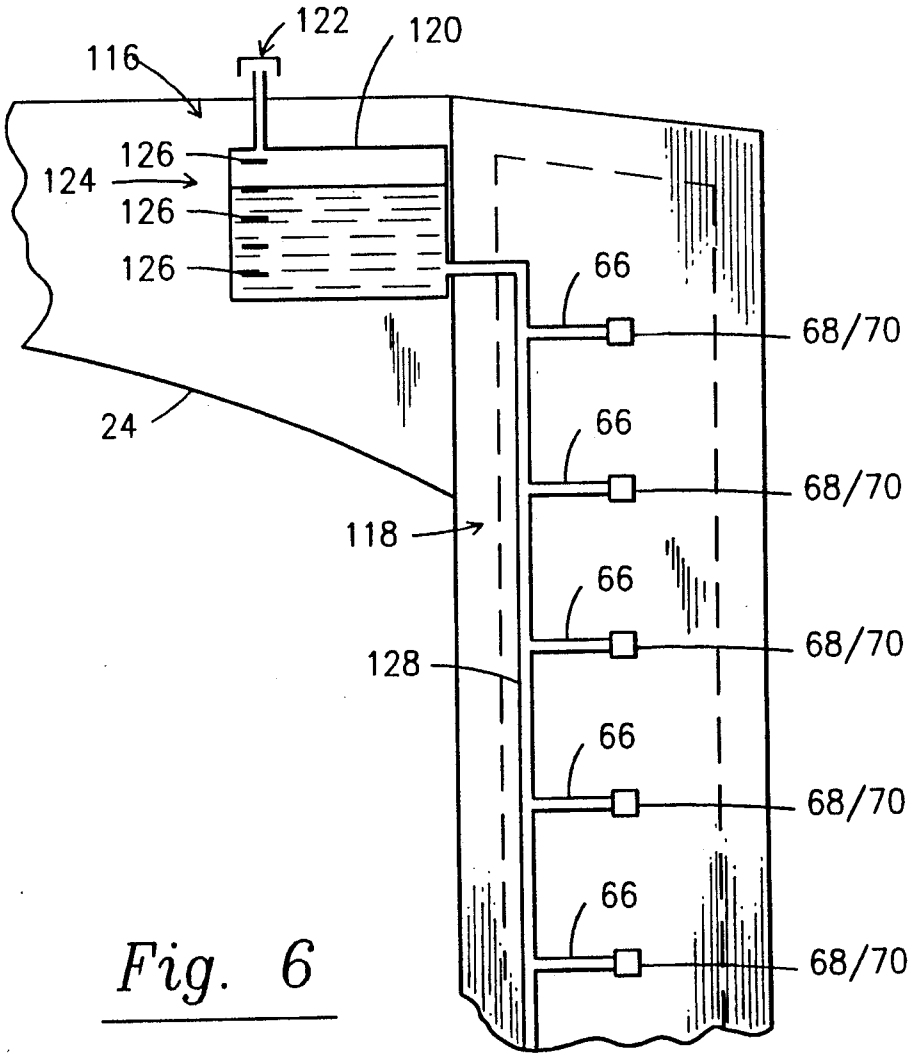
FIG. 6 is a detailed view of the liquid supply means of the present invention.

As best shown in FIG. 6, the corrosive protection system further includes a liquid supply means comprising a liquid supply reservoir and liquid supply manifold generally indicated as 116 and 118 respectively mounted to portions of the tower 18. The liquid supply reservoir 116 comprises a liquid container 120 open to the atmosphere through a liquid reservoir vent 122 having a liquid level indicia generally indicated as 124 comprising a plurality of liquid level markings each indicated as 126. The liquid supply manifold 118 comprises a primary manifold conduit 128 coupled between a liquid reservoir container 120 and each of the plurality of liquid feed conduits 66 to feed the corrosive resistant liquid between the liquid container 120 and the individual bridge cable stay means comprising the individual bridge stay cables 10 and corresponding upper and lower anchor 26 and 28.

When in use, the corrosion protection system immerses the entire length of each cable strand 32 disposed within corresponding cable liquid chamber 36 and the corresponding volume of the anchor caps 64 and 106 of the upper and lower anchors 26 and 28 respectively in a corrosion resistant liquid such as oil. Once the cable-stayed bridge 12 is constructed and the bridge stay cable means are in place, the corrosion resistant liquid is added to the corrosion protection system through the liquid supply reservoir 116 or by introduction through the lower liquid port 108. Specifically, the corrosion resistant liquid is fed from the liquid container 120 through the primary liquid conduit 128 of the liquid supply manifold 118 to the individual bridge stay cable means 30. More particularly, the corrosion resistant liquid is fed to each anchor head cap 64 and corresponding liquid chamber 71, cable liquid chamber 36, liquid chamber 111 and anchor cap 106. Sufficient corrosive resistant liquid is added to the corrosive protection system to at least partially fill the liquid container 120. The discrete liquid level markings 126 corresond to a predetermined volume of corrosive resistant liquid that correspond to predetermined temperatures to provide a visual indication of the total volume of the corrosive resistant liquid within the entire corrosion protection system. Thus an operator can visibly determine if any of the corrosive resistant liquid is lost from the corrosive protection system by comparing the level within the liquid container 120 with the liquid level marking 126 corresponding to the ambient temperature. Of course, a float or other sensing means may be used to provide an electro-mechanical indication of the liquid level of the corrosive resistant liquid. Any individual bridge stay cable means 30 may be isolated from the liquid supply means by closing the corresponding liquid flow control 70. In addition, any individual bridge stay cable means 30 may be drained by opening the corresponding liquid flow control valve 110 and the vent valve 73.

Thus the corrosion protection system provides a positive and verifiable corrosion protection, isolation of the strain in the cable strands 32 from the corresponding outer cable sheaths 34 and furthermore allows the rejacking of the cable strands 32 after construction of the cable-stayed bridge 12.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A corrosion protection system for bridge stay cables of a cable-stayed bridge including at least one tower and a deck or superstructure and at least one bridge stay cable extending between the upper portion of the tower and the corresponding deck, the upper and lower portions of each said bridge stay cable are anchored to the tower and corresponding deck by an upper and lower anchor respectively, each said bridge stay cable and said corresponding upper anchor and lower anchor cooperatively form a bridge stay cable means, each said bridge stay cable comprises a bundle of cable strands disposed in space relationship relative to a corresponding outer cable sheath forming a cable liquid chamber receiving a corrosive resistant liquid isolating said bundle of cable strands from said corresponding outer cable sheath.

2. The corrosion protection system of claim 1 includes a liquid supply means comprising a liquid supply reservoir mounted to the tower.

3. The corrosion protection system of claim 2 whereas said liquid supply reservoir comprises a liquid container open to the atmosphere through a liquid reservoir vent.

4. The corrosion protection system of claim 2 wherein said liquid supply reservoir includes a liquid level indicia providing an indication of the volume of corrosive resistant liquid within said corrosion protection system.

5. The corrosion protection system of claim 4 wherein said liquid level indicia comprises discrete liquid level markings corresponding to a predetermined volume of corrosive resistant liquid that correspond to predetermined temperatures providing a visual indication of the volume of the corrosive resistant liquid within said corrosion protection system.

6. The corrosion protection system of claim 2 wherein said liquid supply means further includes a liquid supply manifold comprising a primary manifold conduit coupled between said liquid supply reservoir and each of said bridge stay cables feeding the corrosive resistant liquid between said liquid supply reservoir and said bridge cable stay means.

7. A corrosion protection system of claim 1 wherein said upper anchor comprises a hollow outer guide having an anchor head disposed therein securing said cable strands to said anchor head, said hollow outer guide forming an anchor liquid chamber retaining corrosion resistant liquid therein.

8. The corrosion protection system of claim 7 including a plurality of liquid flow apertures formed through said anchor head feeding the corrosive resistant liquid between said anchor liquid chamber and said liquid supply reservoir.

9. The corrosion protection system of claim 8 wherein said upper anchor further includes an anchor head liquid reservoir receiving corrosive resistant liquid from said liquid supply reservoir and feed the corrosion resistant liquid between chamber and said anchor head liquid reservoir to said anchor liquid.

10. The corrosion protection system of claim 6 further including a a liquid feed conduit coupling said anchor head liquid reservoir to said liquid supply reservoir.

11. The corrosion protection system of claim 10 further includes a liquid flow control selectively controlling the flow of the corrosion resistant liquid between said liquid supply reservoir and said cable means.

12. The corrosion protection system of claim 7 wherein said anchor cap is in fluid communication with said cable liquid chamber.

13. The corrosion protection system of claim 1 wherein said lower anchor comprises a hollow outer guide having an anchor head disposed therein securing said cable strands to said anchor head, said hollow outer guide forming an anchor liquid chamber to retain corrosion resistant liquid therein.

14. The corrosion protection system of claim 13 including a plurality of liquid flow apertures formed through said anchor head feeding the corrosive resistant liquid between said anchor cap and said liquid supply reservoir.

15. The corrosion protection system of claim 14 wherein said upper anchor further includes an anchor head liquid reservoir receiving corrosive resistant liquid from said liquid supply reservoir, and to feed the corrosion resistant liquid between said anchor liquid chamber and said anchor head cap.

16. The corrosion protection system of claim 13 further including a a liquid feed conduit coupling said anchor cap to said liquid supply reservoir.

17. The corrosion protection system of claim 13 further includes a liquid flow control selectively draining the corrosion resistant liquid from said bridge stay cable means.

18. The corrosion protection system of claim 1 wherein said lower anchor comprises a hollow outer guide having an anchor head disposed therein securing said cable strands to said anchor head, said hollow outer guide forming an anchor liquid chamber to retain corrosion resistant liquid therein.

19. The corrosive protection system of claim 1 further includes a liquid supply means comprising a liquid supply reservoir and liquid supply manifold mounted to the tower, said liquid supply reservoir comprises a liquid container open to the atmosphere through a liquid reservoir vent having a liquid level indicia comprising a plurality of liquid level markings, said liquid supply manifold comprises a primary manifold conduit coupled between a liquid reservoir outlet and each of said plurality of liquid feed conduits feeding the corrosive resistant liquid between said liquid container and said bridge cable stay means.

20. The corrosion protection system of claim 1 wherein said upper anchor includes a port formed thereon having a control valve movable between a first and second position disposed in operative relationship thereto and said lower anchor includes a liquid port formed thereon having a liquid flow control movable between a first and second position disposed in operative relationship thereto such that the corrosive resistant liquid is retained within said cable liquid chamber when said control valve and said liquid flow control are each in said first position, and the corrosive resistant liquid is drained from said cable liquid chamber when said control valve and said liquid flow control are each in said second position.

* * * * *